United States Patent [19]

Eastman

[11] Patent Number: 5,030,111

[45] Date of Patent: Jul. 9, 1991

[54] MODULAR CONNECTOR ASSEMBLY WHICH PROVIDES STRAIN RELIEF

[75] Inventor: Jay M. Eastman, Pittsford, N.Y.

[73] Assignee: Photographic Sciences Corporation, Rochester, N.Y.

[21] Appl. No.: 478,888

[22] Filed: Feb. 12, 1990

[51] Int. Cl.[5] ..... H01R 13/58

[52] U.S. Cl. ..... 439/452; 439/452

[58] Field of Search ..... 439/877, 676, 452, 453, 439/455, 460, 464, 470, 471, 472, 473

[56] References Cited

U.S. PATENT DOCUMENTS

| | | | |
|---|---|---|---|
| 3,670,298 | 6/1972 | Klumpp, Jr. | 439/877 |
| 4,277,124 | 7/1981 | Loose . | |
| 4,422,705 | 12/1983 | Kasper | 439/473 |
| 4,557,545 | 12/1985 | Ohtsuki et al. | 439/470 |
| 4,605,276 | 8/1986 | Hasircoglu . | |
| 4,606,596 | 8/1986 | Whiting . | |
| 4,678,261 | 7/1987 | Mitani et al. | 439/471 |
| 4,714,306 | 12/1987 | Miyazawa . | |
| 4,917,629 | 4/1990 | Matsuzaki et al. | 439/449 |

FOREIGN PATENT DOCUMENTS

| | | | |
|---|---|---|---|
| 2306543 | 10/1976 | France | 439/877 |

*Primary Examiner*—David L. Pirlot

*Attorney, Agent, or Firm*—Martin Lukacher

[57] ABSTRACT

A strain relief member of sheet metal is disposed within the housing of a modular connector having a locking bar which ordinarily is crimped into locking engagement with the wires of a multi-wire cable. With such an arrangement flexure of the wires occurs at the locking bar and the wires break thereby breaking the connection provided by the connector to equipment connected to the cable. The strain relief member has a tray portion over which the wires extend to contacts located near one end of the housing. A stem extends rearwardly from the tray portion out the housing and has arms which are crimped around the cable thereby providing strain relief. The tray has a slot therein which is disposed in alignment with the locking bar. When the locking bar is crimped, it fastens the strain relief member to the housing.

20 Claims, 3 Drawing Sheets

MODULAR CONNECTOR ASSEMBLY WHICH PROVIDES STRAIN RELIEF

The present invention relates to electrical connectors and particularly to modular connectors which provide modular plug assemblies for multi-wire cables.

The invention is especially adapted for use with conventional, modular connector housings having locking bars which ordinarily attach the cable to the connector when crimped against the cable. The invention may be used with other types of connector housings which have locking devices.

It is desirable to use conventional, modular connectors to terminate cables and connect them to receptacles. The cables may be used for example to connect a bar code reader to computer equipment which receives, collects and organizes information as to bar code symbols which are collected by the reader. The cable has a multiplicity of wires which carry signals and which may also carry power for operating the reader. The use of conventional, modular connectors is desirable because they are readily available at low cost. Modular connectors do not afford strain relief because they have locking bars which connect the housing of the connector to the cable, and particularly to the wires of the cable. In ordinary use, the cable flexes and repeated bending of the wires occurs where they are engaged by the locking bar. The wires then break and the cable and its connector must ordinarily be replaced. Even shrouds of elastic material which are molded over the connector and the cable where it enters the connector do not afford sufficient strain relief to prevent failures and allow reliable long-term operation. Special and considerably more expensive connectors have heretofore been necessary to overcome the problem. One such connector is described in Miyazawa, U.S. Pat. No. 4,714,306 issued Dec. 12, 1987. Other similarly complex connector designs are shown in Loose, U.S. Pat. No. 4,277,124 issued July 7, 1981; Hasircoglu, U.S. Pat. No. 4,605,276 issued Aug. 12, 1986; and Whiting, U.S. Pat. No. 4,606,596 issued Aug. 19, 1986.

Accordingly, it is the principal object of the present invention to provide an improved connector assembly which provides strain relief for multi-wire cables which are attached thereto and which is low in cost.

It is another object of the present invention to provide an improved modular connector providing strain relief for the cable attached thereto which is low in cost by virtue of the ability to make use of conventional modular connector housings which are readily available at low cost.

It is a further object of the invention to provide an improved connector with strain relief which is adaptable at low cost for connecting multi-wire cables with different numbers of wires.

It is a still further object of the present invention to provide an improved strain relief member for use in electrical connectors which enables a multi-wire cable to be attached to a connector housing with strain relief.

Briefly described, a connector assembly for a multi-wire cable embodying the invention has a modular housing with opposite ends and the multiplicity of side-by-side terminals near one end thereof. The housing also has an opening therein from the end opposite to the end near which the contact terminals are located into which the cable is inserted with the wires of the cable extending into contact with the contact terminals. The housing has a crimpable locking bar extending transversely of the opening. A strain relief member having a tray portion and a stem extending from the tray portion is located in the opening with the stem extending out of the housing. The stem has crimpable arms extending therefrom. The tray portion has a slot disposed in alignment with the locking bar. The wires extend over the tray. The bar is crimped and extends into the slot to lock the tray in place. The arms are crimped around the cable over the jacket of the cable so as to provide strain relief while attaching the cable to the housing.

The foregoing and other objects, features and advantages of the invention as well as a presently preferred embodiment thereof, will become more apparent from a reading of the following description in connection with the accompanying drawings in which.

Figure 1:
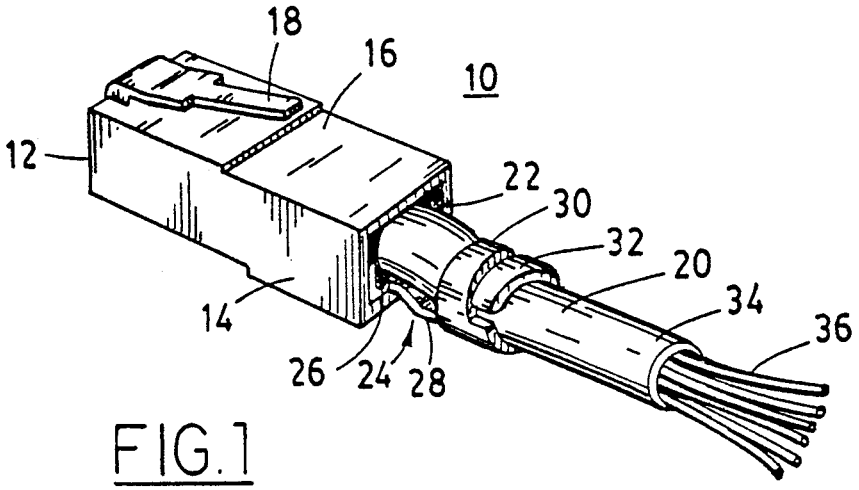
FIG. 1 is a perspective view of a modular connector assembly in accordance with the invention.
Figure 2:
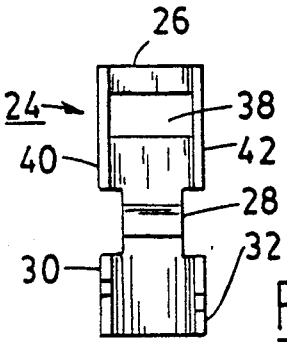
FIG. 2 is a plan view of the strain relief member used in the assembly shown in FIG. 1.
Figure 3:
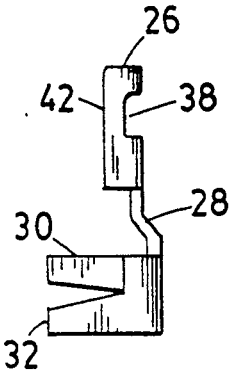
FIG. 3 is a side elevation of the strain relief member shown in FIG. 2.
Figure 4:
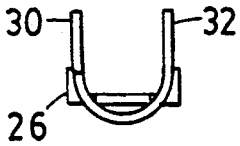
FIG. 4 is an end view of the strain relief member shown in FIG. 2.
Figure 5:
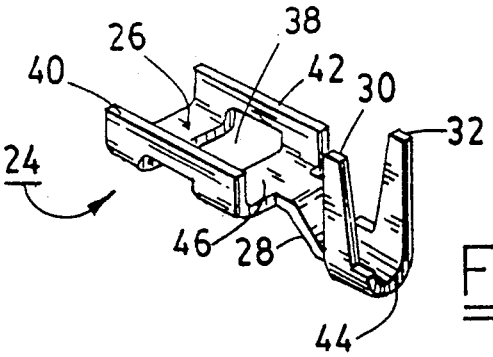
FIG. 5 is a perspective view of the strain relief member shown in FIGS. 2, 3 and 4.
Figure 3A:
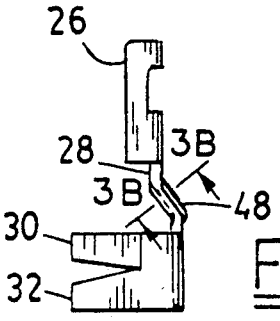
Figure 6:
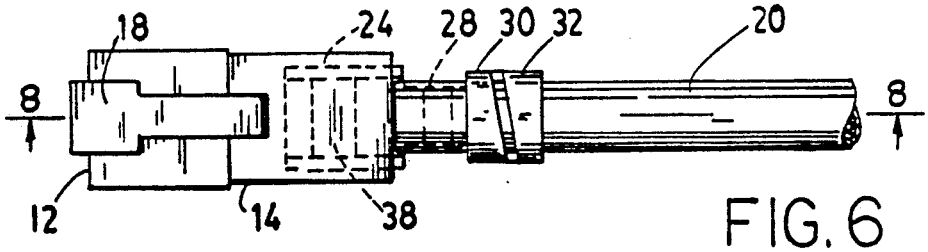
Figure 7:
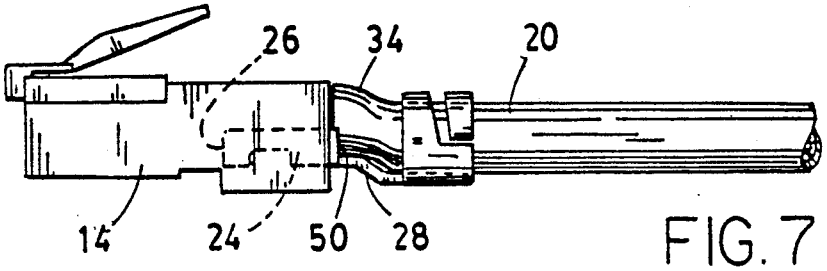
Figure 8:
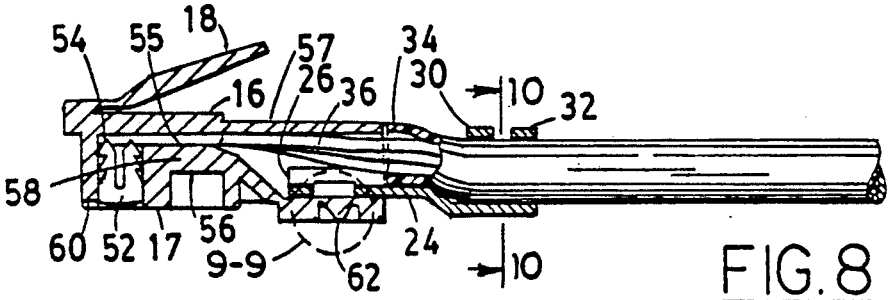
Figure 9:
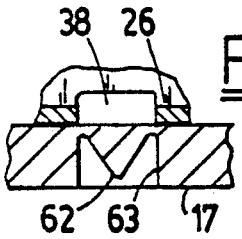
Figure 9A:
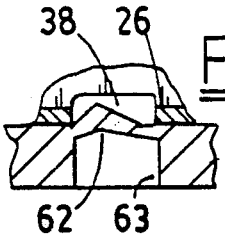
Figure 9B:
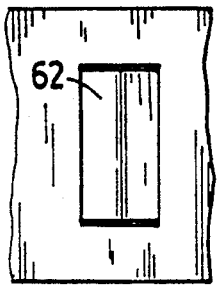
Figure 9C:
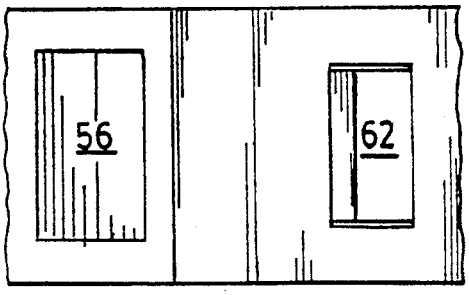

FIG. 3A and B are respectively a side elevation similar to FIG. 3 and a sectional view along the line 3B—3B in FIG. 3A;

FIG. 6 is a plan view of the modular connector assembly shown in FIG. 1;

FIG. 7 is a side elevation of the modular connector shown in FIG. 6;

FIG. 8 is a sectional view of the modular connector shown in FIGS. 6 and 7, the section being taken along the line 8—8 in FIG. 6;

FIGS. 9 and 9A are enlarged views of the locking bar, the view being taken along the line 9—9 in FIG. 8 with the locking bar in uncrimped and crimped condition in FIGS. 9 and 9A, respectively;

FIGS. 9B & C are bottom views showing the locking bar before and after crimping, respectively.

Figure 10:
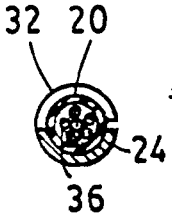
Figure 11:
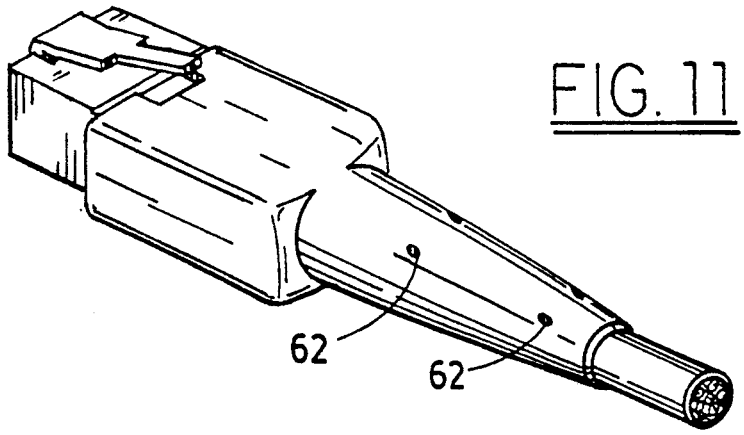
Figure 12:
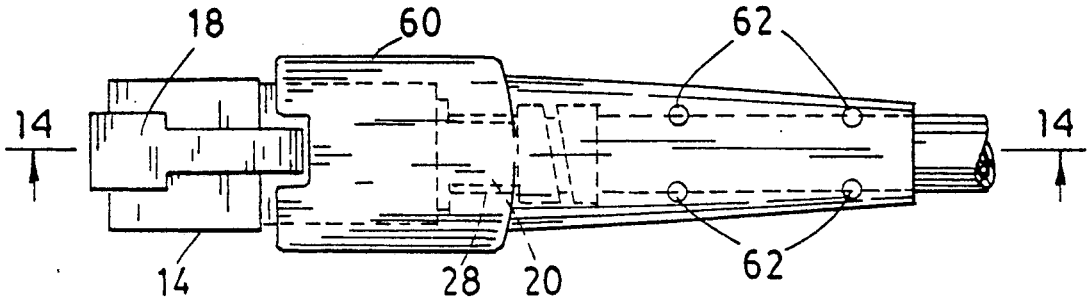
Figure 13:
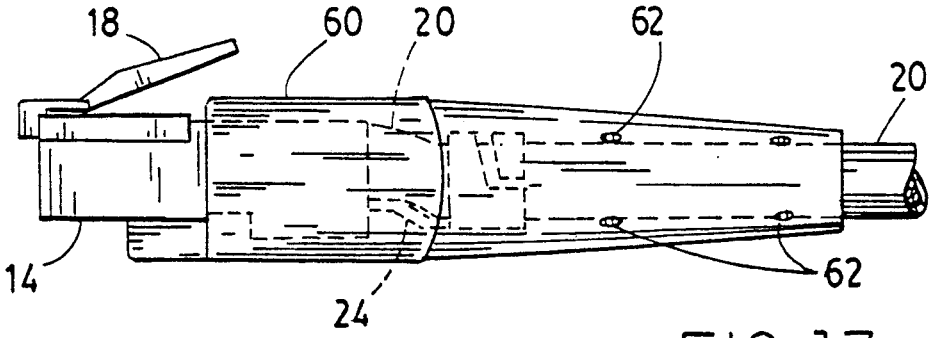

FIG. 10 is a sectional view along the line 10—10 in FIG. 8;

FIG. 11 is a perspective view of the connector shown in FIG. 1 with a molded shroud of elastic material thereon;

FIG. 12 is a plan view of the connector assembly shown in FIG. 11;

FIG. 13 is a side elevation of the connector shown in FIG. 12; and

Figure 14:
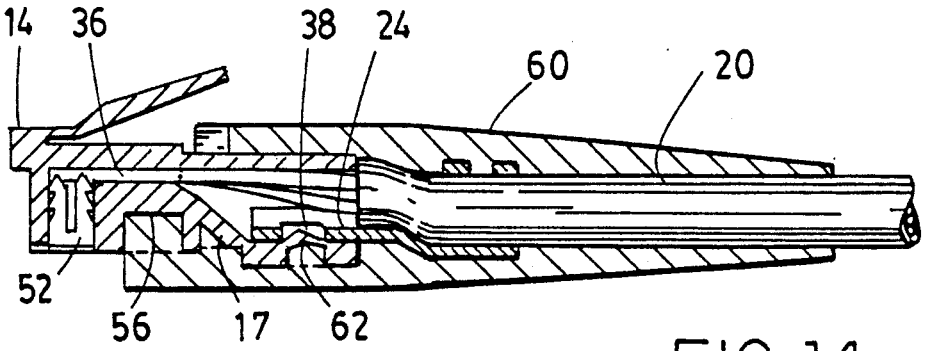

FIG. 14 is a sectional view of the connector shown in FIG. 12 taken along the line 14—14 in FIG. 12.

Referring first to FIG. 1, there is shown a modular connector assembly 10 having a modular housing 14 which is a generally rectangular polygon. This housing may be of the type which is generally available and has a front end 12 which is inserted into a receptacle containing pin terminals. The top 16 of the housing has a detent clip 18 which locks with a latch on the receptacle. A multi-wire cable 20 is inserted into the rear end 22 of the housing 14. Extending from the rear end of the housing is a strain relief member 24. This member has a tray portion 26 the end of which is visible in FIG. 1 and a stem 28 extending rearwardly from the tray portion out of the housing 14. The stem has a pair of crimpable arms 30 and 32 extending from the sides of the stem 28. These arms are crimped around the cable 20 and particularly around the jacket 34 of the cable. It will be appreciated that the jacket extends to the opposite end of the cable and that the six wires 36 extending from the cable illustrate that the cable is a multi-wire cable. It will also be appreciated that the cable can have more or fewer wires. The tray may be wider where there are more wires.

The strain relief member 24 is shown in FIGS. 2, 3, 4 and 5. It is made from a sheet of metal, preferably work-hardenable steel. The tray portion 26 has a slot 38 which extends between sidewalls 40 and 42. This slot serves for attachment of the member 24 to the housing 14 as will become more apparent from FIGS. 8, 9 and 10. The stem 28 is Z-shaped so that the rear end 44 of the stem, from which the arms 30 and 32 extend, is displaced from the base 46 of the tray portion 26 by approximately half the diameter (the radius) of the cable 20.

Figure 3B:
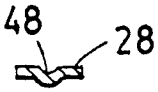

The flexure and strain due to bending of the cable 20 is exerted primarily on the Z-shaped stem portion 28. While the use of work hardenable steel causes the stem to harden and become resistant against flexure, it is also desirable to strengthen and rigidify the section with a longitudinal rib 48 which may be provided by an indentation in the middle of the Z-shaped stem as shown in FIGS. 3A and 3B.

Referring to FIGS. 6, 7 and 8 there is shown, prior to crimping or staking, the connector assembly with the cable attached thereto. The wires extend over the tray and the jacket 34 termination is slightly inwardly of the rear end 50 of the tray. The wires extend over connector terminals 52 one of which is shown in FIG. 8. These terminals are blades with pointed ends 54 which are staked through the insulation surrounding the wires and into the conductive core of the wires as is conventional with modular connectors. It may also be desirable to compress the housing 14 between its top and bottom walls 16 and 17 in the bottom 56 of a slot. The bottom wall 58 of the housing in an area 55 adjacent the terminals 52 may be provided with ribs between which the individual wires are guided into the opening 60 containing the contact terminals 52. A heated swaging tool which compresses the wall and presses the bottom 56 of the slot against the wires and clamps, then to the top wall 57 of the housing may be used for this purpose.

The bottom wall 58 has a locking bar 62 formed therein. The locking bar is integral with the bottom wall of the housing 14 and is in a slot 63, the sides of the locking bar being detached from the sides of the slot as shown in detail in FIGS. 9B & C. The swaging tool crimps the locking bar thereby the wires become engaged and supported by the tray 26. Optionally and possibly in high volume automated production, the tool may be heated so as to slightly melt the thermoplastic material of the locking bar. The locking bar may be pressed into the housing 14, the contact terminals 52 may be inserted through the insulation on the wires and into contact with the conductive cores thereof, (and also the optional staking of the slot bottom 56) by a single multiple element tool on a single stroke. When the locking bar is pressed in, it is deformed and moved to the position shown in FIG. 10A. It enters the slot 38 and prevents lateral and longitudinal movement of the strain relief member 24. FIG. 14 shows the modular assembly in assembled condition with the locking bar 62 in the slot 38 of the strain relief member 24.

As shown in FIGS. 11, 12, 13 and 14, a shroud of elastomeric (flexible rubber or plastic) material may be molded around the cable and extend into the slots in the bottom wall of the housing 14. This elastic material shroud is indicated at 60. It will also be observed that the cable 20 overlies the stem 28 of the strain relief member 24. The holes 62 are used to hold the cable 20 centered in the mold during the molding process.

From the foregoing description, it will be apparent that there has been provided an improved electrical connector in which the strain relief for the wires of a multi-wire cable is provided and also an improved strain relief member. Variations and modifications in the herein-described connector and strain relief member, within the scope of the invention, will undoubtedly suggest themselves to those skilled in the art. Accordingly the foregoing description should be taken as illustrative and not in a limiting sense.

I claim:

1. A connector assembly for a multi-wire cable having a plurality of wires, said assembly comprising a housing having opposite ends with a multiplicity of side-by-side contact terminals near one of said opposite ends and an opening therein from the other of said opposite ends into which said cable is inserted with said wires extending into contact with individual ones of said contact terminals, said housing having a crimpable locking bar extending transversely of said opening and presenting a surface facing said opening, a strain relief member having a tray portion with opposite ends and a stem extending from one of said ends, said stem having sides, at least one crimpable arm extending from one of said sides, said tray portion having a slot, said strain relief member being disposed in said opening with said wires extending over said tray and over said stem, said bar being crimped and said surface thereof extending into said slot to lock said member in place in said housing, and said arm being crimped around said cable over said wires.

2. The assembly according to claim 1 wherein said crimpable arm is a first of a pair of crimpable arms, said first arm and a second of said pair of crimpable arms extending from opposite sides of said stem, and both of said arms being crimped around said cable over said jacket.

3. The assembly according to claim 1 wherein said wires are contained in a jacket, said jacket extending over said stem, said tray having a base in which said slot is disposed and sidewalls extending in the same direction from said base, said wires being disposed between said sidewalls, said jacket having a termination at said tray, said wires extending away from said termination.

4. The assembly according to claim 3 wherein said jacket termination extends into said tray.

5. The assembly according to claim 3 wherein said housing is a generally rectangular polygonal body having said opposite ends, opposite side faces and top and bottom faces extending between said side faces, said opening defining side walls between said openings and said side faces and top and bottom walls between said top and bottom faces and said opening, said locking bar being disposed in one of said top and bottom walls in alignment with said slot and said bar being disposed in said slot when crimped.

6. The assembly according to claim 5 wherein said contacts are plates extending from said one of said top and bottom walls toward and in contact with said wires near the ends thereof.

7. The assembly according to claim 5 wherein said bar is a crimpable portion of said one of said top and bottom walls.

8. The assembly according to claim 7 wherein said housing is a body of thermoplastic material.

9. The assembly according to claim 3 wherein said strain relief member is a sheet of metal.

10. The assembly according to claim 9 wherein said metal is work hardenable steel.

11. The assembly according to claim 9 wherein said base is a flat portion of said sheet, said side walls are bent portions of said sheet, and said stem is a strip portion of said sheet extending along the line through the center of said sheet between said side walls.

12. The assembly according to claim 11 wherein said stem is Z-shaped in part and has an end section offset from said base by a displacement equal approximately to the radius of said jacket, said arms extending from said end section.

13. The assembly according to claim 12 wherein said Z-shaped part has an indentation defining a rib extending longitudinally of said part.

14. A strain relief member for retaining a multi-wire cable in a modular connector having a body and a wire-locking bar, said member comprising a tray on which the wires of said cable are engaged and supported a stem extending from said tray, a slot in said tray for receiving said wire-locking bar on assembly of said connector enabling the attaching of said member in assembled relationship with said connector body, and arms extending from said stem, said arms being crimpable around said cable.

15. The member according to claim 14 wherein said tray has a base in which said slot is disposed, and side walls extending in the same direction from said base, said wires being disposed between said side walls.

16. The member according to claim 14 wherein said crimpable arms extend from opposite sides of said stem and are offset in a direction longitudinally of said stem from each other.

17. The member according to claim 14 wherein said stem is Z-shaped in part and has an end section offset from said base by a displacement approximately equal to a radius of said cable, said arms extending from said end section.

18. The member according to claim 17 wherein said Z-shaped part has an indentation defining a rib extending longitudinally of said part.

19. The member according to claim 14 wherein said strain relief member is made of a sheet of metal.

20. The member according to claim 19 wherein said metal is work hardenable steel.

* * * * *